United States Patent [19]

Gravitter et al.

[11] 4,203,541

[45] May 20, 1980

[54] AFFIXING CUSHIONING PADS TO FLOOR SLEEPERS

[75] Inventors: Robert U. Gravitter, Houghton; William O. Isaacson, Laurium, both of Mich.

[73] Assignee: Horner Flooring Company, Dollar Bay, Mich.

[21] Appl. No.: 896,213

[22] Filed: Apr. 13, 1978

[51] Int. Cl.[2] ..... B27F 7/02

[52] U.S. Cl. ..... 227/40; 227/48; 227/100; 227/153; 29/430

[58] Field of Search ..... 29/430, 464 R, 526; 227/40, 48, 50, 100, 120, 152, 153

[56] References Cited

U.S. PATENT DOCUMENTS

| | | | |
|---|---|---|---|
| 1,680,187 | 8/1928 | Watson et al. | 227/48 |
| 2,950,480 | 8/1960 | Sower | 227/152 |
| 3,302,841 | 2/1967 | Beck | 227/50 X |
| 3,763,547 | 10/1973 | Blakeslee | 29/430 |
| 3,822,815 | 7/1974 | Davis | 227/40 X |
| 3,876,128 | 4/1975 | Feren | 227/100 X |

*Primary Examiner*—Paul A. Bell

*Attorney, Agent, or Firm*—Schuyler, Birch, McKie & Beckett

[57] ABSTRACT

Apparatus for affixing spaced cushioning pads to wooden floor sleepers has a positioning channel to hold a sleeper to be padded with lifting means provided to raise the sleeper into working position, cushioning pads are placed at spaced positions along the length of the sleeper by ejector means moving individual pads from each of a series of feeder channels carrying stacks of such pads and placing these pads to overlie the sleeper, and stapling guns are in operative relation with the pads and sleeper to affix each pad to the sleeper at its spaced position along the sleeper length whereupon the sleeper is released from the working position for removal from the positioning channel.

12 Claims, 2 Drawing Figures

AFFIXING CUSHIONING PADS TO FLOOR SLEEPERS

BACKGROUND OF THE INVENTION

1. Field of the Invention

This invention relates to the affixation of cushioning pads to floor sleepers utilized particularly in industrial or commercial flooring. More specifically the invention relates to apparatus for automatically applying pads spaced along the length of sleepers which are then used in flooring installations.

2. Description of the Prior Art

In the prior art, various types of apparatus have been proposed for assembling and fastening together members such as employed for wooden box ends, pallets, wooden fence units, wall units, etc. These have adopted the approach in a number of cases wherein stacks of the elements to be connected together are maintained in supply magazines and are mechanically moved into position relative to other elements from adjacent magazines and fastening means inserted to connect the appropriately positioned elements together. Fastening by use of staples, nails, etc., has been proposed in the prior art for constructing the various units as desired.

However, the prior art does not teach the concept where cushioning pads are affixed to a floor sleeper which is to be used underlying a floor such as made up of tongue and groove wood flooring strips. The prior art does not disclose apparatus having a work table with a longitudinal channel for receiving an elongated member therein along with means for automatically placing a plurality of spaced pads on the member, pressing the pads and member together and then effecting an automatic securing thereof. A substantial need exists to have large quantities of floor sleepers provided with cushioning pads at spaced points along the length of each sleeper. Such is not supplied by any of the prior art teachings to date.

SUMMARY OF THE INVENTION

The apparatus contemplates supplying the lack of the prior art by providing an automatic apparatus for affixing spaced cushioning pads to wooden floor sleepers. The sleeper to be padded is placed in a positioning channel to hold the sleeper and is lifted to a working position for application of the cushioning pads. The pads are placed at spaced positions along the length of the sleeper by individual pads being ejected from a series of feeder channels which carry stacks of these pads and placed to overlie the sleeper. The stapling guns in operative relation with the pads and sleeper affix each pad to the sleeper at its location along the sleeper length. Thereupon the sleeper is released from the working position for removal from the positioning channel. Subsequently another sleeper may be placed in the channel of the apparatus and the process repeated to affix the spaced pads along the length of the sleeper.

It is a primary object of the present invention to provide apparatus for automatically affixing cushioning pads at spaced positions along the length of a floor sleeper.

A further important object of the invention is to provide an apparatus as recited in the above object wherein accurate and positive positioning of the cushioning pads relative to the surface of the sleeper is achieved with effective affixation of the pads to the sleeper by utilization of stapling guns lowered into operating position over the pads and sleeper.

A further object of the invention is to provide automatic apparatus for affixing cushioning pads to floor sleepers at spaced positions along the length of each sleeper wherein lifting means raises the sleeper into working position where the pads are placed over the upper surface of the sleeper with the lifting means having sleeper impaling spikes which serve to firmly hold the sleeper during the pad affixation operation and serve to draw the sleeper downwardly into a positioning channel to free the sleeper for removal from such channel after the pads have been affixed.

BRIEF DESCRIPTION OF THE DRAWINGS

The novel features of the invention are set out with particularity in the appended claims, but the invention will be understood more fully and clearly from the following detailed description of a preferred embodiment of the invention as illustrated in the accompanying drawings, in which;

DESCRIPTION OF A PREFERRED EMBODIMENT

Figure 1:
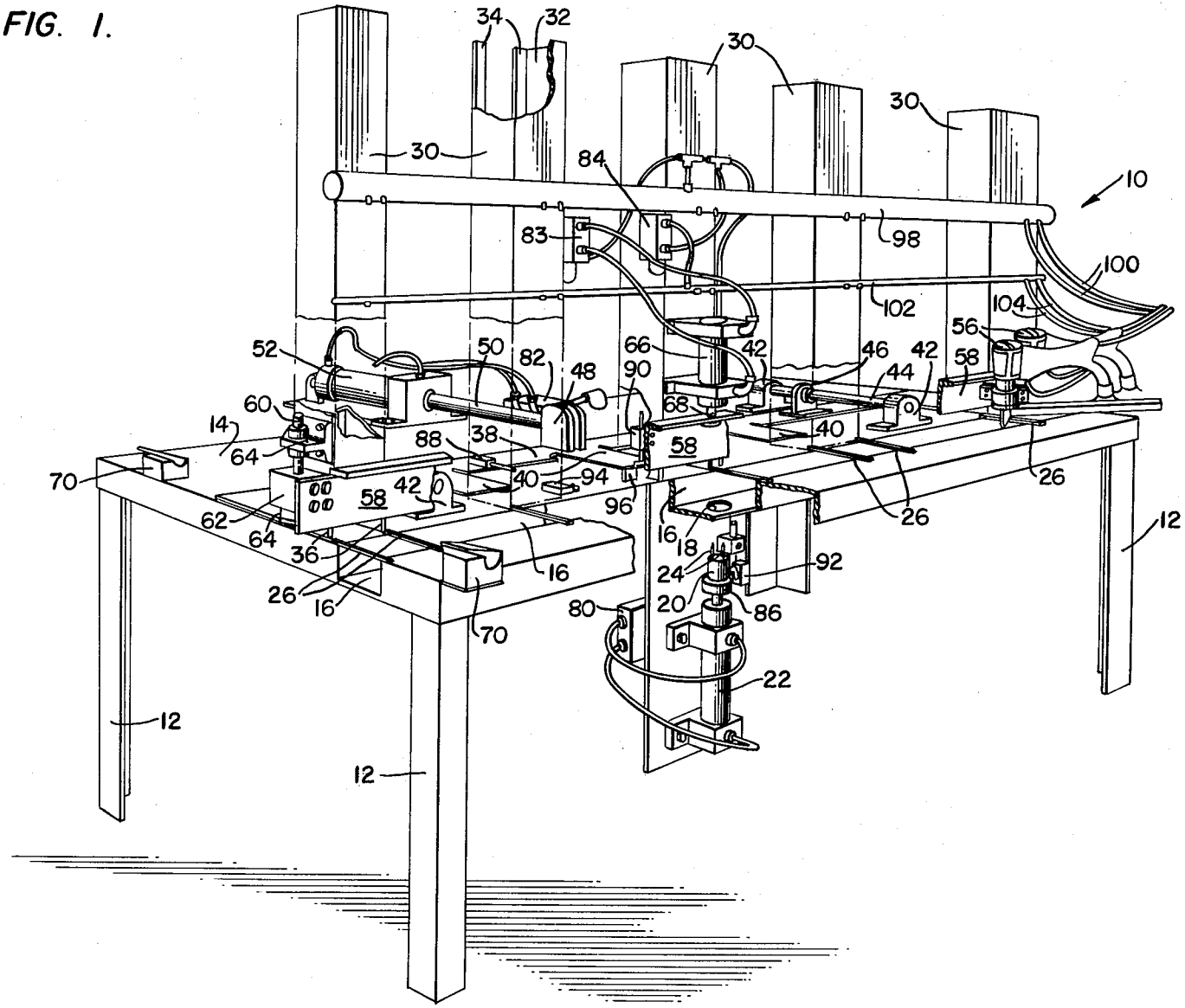
FIG. 1 is an overall perspective view of the apparatus for affixing spaced cushioning pads to wooden floor sleepers of the invention.

Referring to FIG. 1, apparatus 10 for affixing cushioning pads spaced along the length of a floor sleeper is shown supported on legs 12. The apparatus includes a bed 14 which has a channel 16 recessed in the upper surface thereof, the channel opening upwardly through the top of bed 14. This channel 16 forms a part of the positioning means wherein a floor sleeper (not shown) is held during affixation of the cushioning pads at spaced locations along the length of the floor sleeper. The sleeper to be padded is moved longitudinally into the channel 16 and generally centered within the channel. The bottom wall of channel 16 has a hole 18 formed therein generally midway of the length of channel 16 to accommodate a lifting means to act in raising the sleeper within channel 16 from a remote position resting on the bottom of channel 16 to a working position at the upper open end of channel 16.

Figure 2:
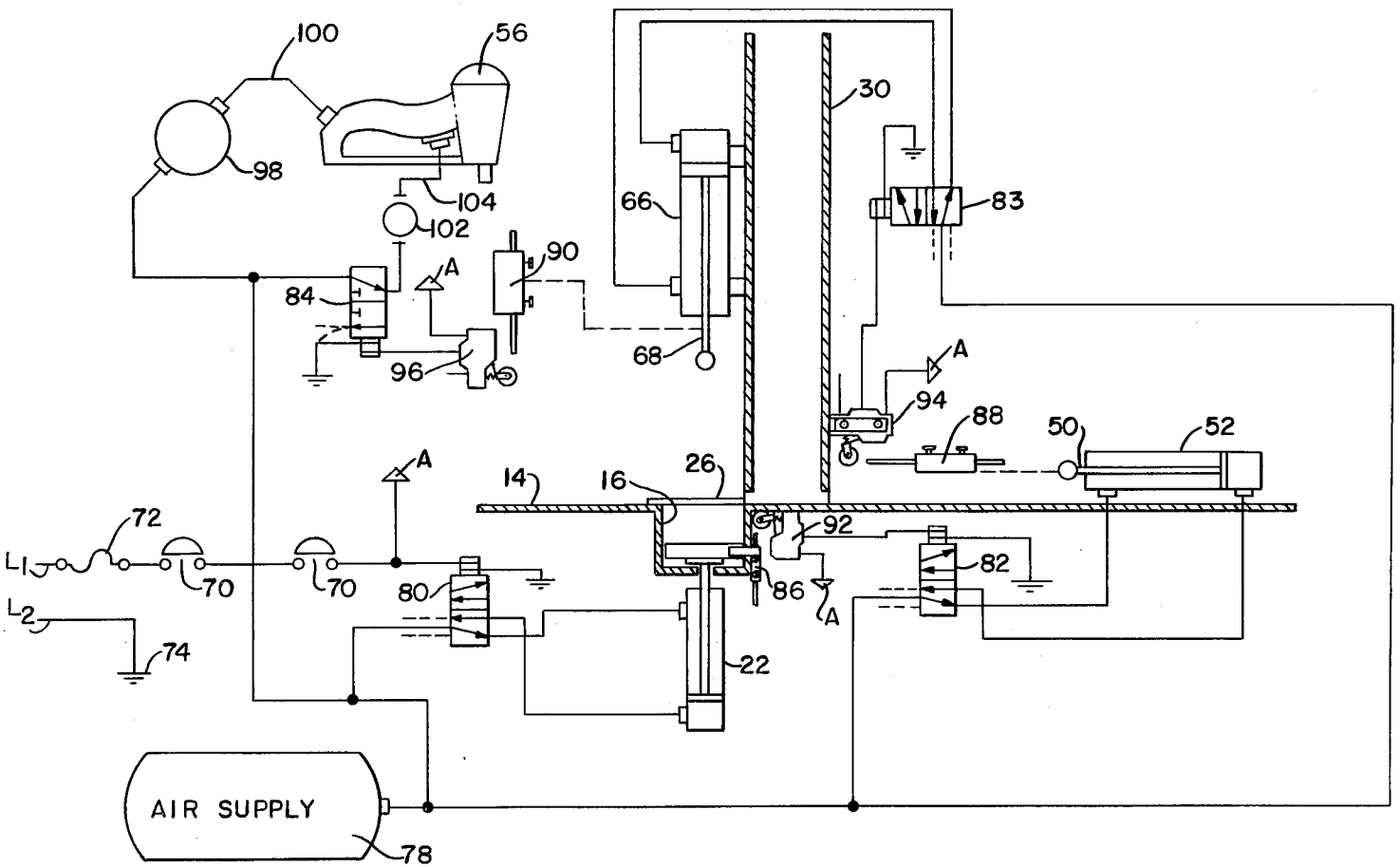
FIG. 2 is a perspective view of the pneumatic system for control of the components of the apparatus shown in FIG. 1, the system being shown related to certain portions of the apparatus shown in Section.

The lifting means comprises a cylindrical member 20 mounted on the piston rod of a pneumatic reciprocal lifter cylinder 22. Actuation in raising and lowering the cylindrical member 20 to move the sleeper to its working position is shown in the schematic of FIG. 2 which will be described subsequently. The cylindrical member 20 on the piston rod of lifter cylinder 22 carries spikes 24 on the upper end thereof so that when the member 20 is raised by lifter 22 to pass upwardly through hole 18 in channel 16 the spikes 24 impale the underside of the sleeper to securely hold the sleeper against displacement during affixation of the pads while the sleeper is held in the working position. Also, these spikes 24 assure that the sleeper is drawn downwardly into channel 16 once the pads have been stapled in place.

Extending across the upwardly opening end of channel 16 are several pairs of parallel bars 26. Each pair of these bars is spaced apart at each location where a pad is to be affixed to receive therebetween a pad and hold it overlying the sleeper that is located in the working position in channel 16. The feeding of the pads to the several locations where the pairs of bars 26 are disposed will now be described.

The cushioning pads (not shown) to be affixed spaced along the length of a floor sleeper are dispensed to the locations for the pads overlying the sleeper from a series of magazines 30. Each magazine is made up of a feeder channel 32 with the open side of each feeder channel 32 having inturned lips 34 extending along the edges of this open side. Each magazine 30 retains within its channel 32 a stack of cushioning pads which are to be affixed to the sleeper supported in its working position in channel 16. The series of magazines 30 are amounted in spaced upstanding relation to one another as shown in FIG. 1 and are open at their lower ends to rest the stack of cushioning pads on the surface of bed 14 which is laterally disposed along the length of the channel 16. The lower open end of each magazine channel 32 is spaced above the surface of bed 14 so that the lower most pad within the stack retained in feeder channel 32 may be removed from the bottom of the pad stack to be positioned between the parallel bars 26 in the predetermined locations which are adjacent the magazines 30. The pad ejector will place the pads to overlie the sleeper in channel 16 when the sleeper is in its working position. This spaced mounting of the open lower ends of the feeder channels 32 for magazines 30 is shown with respect to the first and third magazines 30 taken from the left as shown in FIG. 1, wherein it will be clear that the sides of the channels 32 have skirts 36 resting on the surface of bed 14 whereas the opposite walls of the channels 32 are recessed to permit removal of a cushioning pad from beneath the stack of pads within each magazine channel 32.

To remove a pad from a stack in each of the magazines 30, an ejector plate 38 is mounted to slide along the upper surface of bed 14 and act to remove simultaneously a pad from each of the magazines 30 and place these pads at the predetermined locations relative to the sleeper in channel 16. The pads are removed from the bottom of the stack of each magazine channel 32 and shifted in between the pairs of bars 26 which locate the pads to overlie the sleeper in its working position at the predetermined locations determined by the positions of magazines 30 and bars 26, located to receive the pads from the series of magazines 30. The ejector plate 38 includes a series of delivery feet 40. These extend toward upwardly opening channel 16 from the continuous back portion of the ejector plate 38 and are spaced along the length of the base of the ejector plate 38 to correspond with the spacing between the series of magazines 30. As the ejector plate 38 is moved forward toward channel 16, the delivery feet 40 move in beneath the stack of pads in each magazine channel 32 removing one pad therefrom and pushing it toward and between the spaced pairs of bars 26 so that each of the pads in the predetermined locations to be affixed to the sleeper overlies the sleeper for performance of the affixing operation of the pads to the sleeper.

The ejector plate 38 is guided for its movement toward and away from channel 16 so that all delivery feet 40 simultaneously remove a pad and place them between successive sets of parallel bars 26 by the feet moving beneath the magazines 30 to the rear edge of channel 16. Then the plate 38 is withdrawn in readiness to remove another set of pads from the magazines 30 in conjunction with affixing spaced cushioning pads to the next floor sleeper located in working position within channel 16. Adjacent each end of ejector plate 38 there are provided shaft supports 42 spaced forwardly and rearwardly and affixed to the surface of bed 14. These supports 42 carry a shaft 44. A pillow block 46 is affixed to ejector plate 38 adjacent each end thereof with this pillow block 46 slidably engaged with shaft 44. Thus, movement of plate 38 is kept parallel to the channel 16 so that the delivery feet 40 of the ejector plate 38 simultaneously place the pads at the predetermined locations defined between the pairs of bars 26. A drive element 48 secured to the upper surface of ejector plate 38 at the mid-point thereof. This element has the piston rod 50 of a pneumatic driver 52 connected thereto. The cylinder of this driver 52 is fastened to the upper surface of bed 14 so that extension and retraction of the piston rod 50 which is connected to the element 48 acts to move the ejector plate 38 forward to remove the pads from the magazines 30 to place them between bars 26 while retraction of rod 50 withdraws ejector plate 38 to the position shown in FIG. 1.

Each of the cushioning pads is affixed in its predetermined location to the sleeper disposed in working position within channel 16 by stapling guns 56. Two such stapling guns are mounted over each of the predetermined locations at which a cushioning pad is to be affixed to the floor sleeper in channel 16. Two of such guns are shown in FIG. 1 at the far right of the apparatus. Whereas any suitable stapling gun may be employed for affixing the pads to the floor sleeper, an appropriate type gun is provided by the Duo-Fast Model No. 5018. By providing the two parallel stapling guns at each of the predetermined locations for pad affixation, each side of the pad will be affixed to the floor sleeper disposed in working position within channel 16.

The pairs of stapling guns 56 at each of the predetermined locations for pad affixation are mounted on a bracket 58. This bracket, as shown in FIG. 1, is broken away in certain areas so that portions of the apparatus disposed behind the bracket 58 in the perspective of FIG. 1 can be clearly seen. Each end of the bracket 58 is mounted for guided movement by a shaft 60 which is secured to a block 62 that is, in turn, bolted to the end of bracket 58. Shaft 60 is mounted to slide in a pair of pillow blocks 64. The pillow blocks 64 are appropriately fastened to the outer side walls of the end cushioning pad magazines 30. This mounting is shown at the left end of the apparatus on FIG. 1 and it will be understood that a similar mounting is present at the opposite end of bracket 58. The mounting of shaft 60 in the pillow blocks 64 guides the reciprocating vertical movement of bracket 58 so that all of the stapling guns 56 are moved simultaneously from retracted positions for the group of stapling guns disposed above the predetermined locations for pad affixation to the floor sleeper to operating positions where the stapling guns lie directly over and in position to, when activated, staple the pads onto the sleeper in channel 16 in its working position.

To raise and lower the bracket 58 carrying the group of stapling guns 56 a pneumatic actuator 66 is mounted on the front wall of the center magazine 30 with the cylinder thereof being fixedly secured to this wall and the piston rod 68 of actuator 66 being secured to the flange of bracket 58. Thus, by application of pneumatic pressure to the upper or lower end of the cylinder of actuator 66 with concurrent venting of the opposite end of the cylinder the bracket 58 will be reciprocated downwardly or upwardly as needed for moving the stapling guns 56 simultaneously from retracted positions above the predetermined locations for pad affixation to operating positions where activation of the stapling guns will affix the pads to the sleeper in its working position within channel 16.

Description of the schematic for the pneumatic circuit employed in carrying out operation of affixing cushion pads to a floor sleeper will be described hereinafter. In the control of this circuit, the operator initially places a floor sleeper to be padded within channel 16. As a safety precaution a pair of start switches 70 are mounted on the surface of the bed 14 spaced at the end of bed 14 so that the operator is required to use both hands to close both switches 70 simultaneously in order to start the process of affixing the cushioning pads to the sleeper. Due to the widely spaced locations of switches 70, the operator has his hands removed from any location where possible injury in operation of the machine might occur.

Referring to the schematic of FIG. 2, the left end of the schematic shows the power input lines L1 and L2 which are connected to an electrical power source. A fuse 72 is connected in line L1 while line L2 is connected to ground on the apparatus at 74. The two switches 70 are shown in series such that they must be simultaneously closed in order to energize the apparatus. The power supply may be standard 120 volt alternating current. The ground 74 on the machine provides a negative base for actuation of the various solinoid actuated valves included in the penumatic system which controls the apparatus.

To provide control air pressure for operation of the pneumatic system an appropriate air pressure supply is provided as represented by the tank 78 label "AIR SUPPLY" on FIG. 2 which will be maintained by an air compressor (not shown).

Referring first to the operation of the lifting means, involving raising cylinder 20 carrying spikes 24 by means of providing air pressure to or from the pneumatic lifter cylinder 22, there is, as shown in FIG. 2, a solenoid valve 80.

The following comments may be made for a better understanding of the schematic pneumatic system shown on FIG. 2. For simplicity in illustration, it is to be understood that each of the points marked A on FIG. 2 are commonly connected such that the voltage of line L1 will be communicated to each of the normally open micro-switches hereinafter described as included in the system. Three of the four solenoid valves are four way solenoid air valves such as Skinner Model H935DB2150 while the fourth valve is a three way solenoid air valve such as Schrader Model 972-S.

Basically, the solenoid valve 80 controls the lifter cylinder 22 of the lifting means within channel 16 to raise the floor sleeper to its working position. The piston rod of cylinder 22 carries the cylindrical member 20 shown diagramatically on FIG. 2.

A solenoid valve 82 functions to control the operation of the pneumatic driver 52 to extend or retract its piston rod 50 in moving the ejector plate 38 carrying delivery feet 40 as to remove a set of pads from each magazine 30 and place them between the sets of parallel bars 26 overlying the sleeper in channel 16. A four way solenoid valve 83 is connected to control pneumatic actuator 66. Likewise, a solenoid 84 is connected to control activation of the group of stapling guns 56.

The piston rod of the pneumatic cylinder 22 carries a switch actuator 86 which takes the form of a ring on cylindrical member 20 in FIG. 1 and which moves up and down with the operation of pneumatic cylinder 22 under control of solenoid valve 80. A switch actuator 88 is mounted to reciprocate with piston rod 50 of pneumatic driver 52 that slides the ejector plate 38 forward and rearward on the surface of bed 14 to remove pads from the stacks in the magazines 30 and place them over the sleeper in its working position within channel 16. The piston rod 68 of pneumatic actuator 66 carries, to move therewith, a switch actuator 90.

The underside of bed surface 14 has mounted thereon a normally open micro-switch 92 which is actuated by the upward movement of switch actuated 86 carried by pneumatic cylinder 22. A normally open micro-switch 94 is stationarily mounted on the center magazine 30 to be moved to a closed condition upon switch actuator 88 being moved by piston rod 50 of pneumatic driver 52 in sliding ejector plate 38 forwardly for placing the cushioning pads in the respective locations between parallel bars 26. A normally open micro-switch 96 is secured in fixed position relative to the bed 14 such as to be moved to a closed condition when switch actuator 90 moved downwardly under the action of piston rod 68 of pneumatic actuator 66.

It will be seen that the air pressure supply from compressed air tank 78 is connected to each of solenoids 80, 82, 83 and 84. The air pressure line also extends to a manifold 98 which has air supply lines 100 (see FIG. 1) going to each of the stapling guns 56 at the group of locations where pads are to be affixed to a sleeper. Air for activating the group of stapling guns 56 is applied through a manifold 102 to activate each of the stapling guns 56 simultaneously under control of the three way solenoid valve 84. Air pressure lines 104 lead from the manifold 102 to each of the stapling guns 56.

The overall operation of the pneumatic system and apparatus may best be described by reference to the schematic shown on FIG. 2. With the apparatus in inactive condition the two switches 70 remain open and no energy is being applied to any of the components of the apparatus. A floor sleeper is inserted into channel 16 and appropriately located in readiness to have the group of cushioning pads stapled thereto.

At this point the two switches 70 are closed manually by the operator. The lifting means carrying spikes 24 is below the bottom of channel 16, the ejector plate 38 is retracted and the group of stapling guns 56 are raised by bracket 58 being in its upper position. In this condition of the apparatus when the switches 70 are both closed solenoid 80 is energized to communicate air pressure to the underside of the piston in pneumatic cylinder 22 while the upper side of such piston is vented to atmosphere. This raises the cylindrical member 20 carrying spikes 24 through hole 18 in channel 16 whereupon the sleeper in such channel is impaled and moved upwardly to its working position pressed against the underside of bars 26. Incident this movement, the switch actuator 86 also moves upwardly to close normally open micro-switch 92. Closure of switch 92 energizes solenoid 82 whereupon air pressure is applied to the rear side of pneumatic driver 52 extending piston rod 50 to move ejector plate 38 and remove a set of pads from the magazines 30 to place them between the pairs of bars 26 overlying the upper surface of the sleeper in its working position. This latter movement causes switch actuator 88 to be moved forward to close normally open micro-switch 94. Closure of switch 94 energizes solenoid 83 which connects air pressure to the upper side of pneumatic actuator 66 while underside is vented. This lowers piston rod 68 of the actuator carrying bracket 58 with the stapling guns 56 thereon from the retracted positions of guns 56 to operating positions whereupon activation of the stapling guns 58 will staple the cushioning pads to the sleeper disposed in the working position within channel 16. Downward movement of piston rod 68 carries switch actuator 90 downwardly to close normally open micro-switch 96. Closure of switch 96 then operates solenoid valve 84 to apply activating air pressure through manifold 102 and lines 104 to simultaneously activate all of the stapling guns 56.

When the stapling guns 56 have been activated and thereby fired the staples through the pads into the floor sleeper in channel 16, the switches 70 will be released by the operator, de-energizing all of the solenoid valves such that the pneumatic operators return the lifting means to its position below channel 16, the ejector plate 38 is retracted rearwardly of the magazines 30 and bracket 58 carrying the stapling guns 56 is raised so that the now padded sleeper may be slid out of the channel 16 and a new sleeper placed in the channel for the next pad affixation operation.

It will certainly be appreciated that although one mode of automatic sequential operation for the apparatus has been described with reference to the pneumatic schematic diagram shown on FIG. 2, other appropriate control systems may be employed and easily adapted for performing the desired sequence of actuation of the various components of the pad stapling operation of floor sleepers. Likewise, although air under pressure in a pneumatic system has been described it will be understood that within the scope of this invention the control system may be hydraulic or electromechanical, etc.

Although the present invention has been illustrated and described in terms of a preferred embodiment, numerous modifications may be made without departing from the true spirit and scope of the invention. The scope of the invention is therefore to be limited only by the appended claims.

We claim:

1. Apparatus for affixing pads spaced along the length of a floor sleeper comprising:

positioning means to hold a sleeper in a working position for affixation of a plurality of pads spaced along the sleeper including spaced parallel wall means to retain the sleeper along both of its sides to retain it against lateral displacement during pad affixation and lifting means disposed to raise the sleeper from a remote position between said wall means into said working position;

a series of magazines spaced along the length of said positioning means with each magazine adapted to hold a stack of pads;

means associated with each magazine operable to place a pad from the magazine at a predetermined location relative to a sleeper held in said working position by said positioning means; and pad affixing means mounted in operative relation to each said location for affixing the pad to the sleeper at each said location.

2. Apparatus as recited in claim 1 wherein each said location places the pad overlying the sleeper held by said positioning means and said pad affixing means comprises at least one stapling gun mounted above each said location.

3. Apparatus as recited in claim 2 wherein a pair of stapling guns are mounted parallel to each other at each said location to double staple each pad to the sleeper at each said location.

4. Apparatus as recited in claim 2 wherein said at least one stapling gun at each said location is movably mounted to reciprocate from a retracted position to an operating position incident stapling the pads to the sleeper.

5. Apparatus as recited in claim 1 wherein said pad affixing means at all of said locations comprise at least one stapling gun and all are mounted to be reciprocal simultaneously from retracted positions above said locations to operating positions relative to said locations incident affixing the pads to the sleeper.

6. Apparatus as recited in claim 1 wherein said lifting means is verticaly reciprocable beneath the locale for the sleeper and carries spikes to impale the sleeper in raising it into said working position so the sleeper is securely held against displacement during affixation of the pads.

7. Apparatus as recited in claim 1 wherein each of said series of magazines comprises a feeder channel having inturned lips extending along the edges of the open side of said feeder channel, said series of magazines are upstanding and open at their lower ends onto a surface laterally disposed along the length of said positioning means, and said pad placing means for each said magazine includes an ejector plate mounted to slide along said surface to remove a pad from the stack in each of said magazines and place the pads at said predetermined locations relative to the sleeper.

8. Apparatus as recited in claim 7 wherein said ejector plate includes laterally spaced delivery feet, one for each magazine feeder channel to slide beneath the magazine channels in removing a pad from each channel and placing the pads at said predetermined locations.

9. Apparatus as recited in claim 7 wherein each said pad affixing means comprises at least one stapling gun mounted above each said location, and said stapling guns are collectively mounted spaced to be over the sleeper locale at said locations on a vertically reciprocable bracket which simultaneously moves said stapling guns from retracted positions above said locations to operating positions for stapling the pads to the sleeper.

10. Apparatus as recited in claim 1 wherein pneumatic means are provided to actuate said lifting means, a pneumatic driver is associated with said pad placing means to simultaneously place pads in said locations, said pad affixing means comprises at least one stapling gun, said stapling guns being reciprocably mounted and being simultaneously moved while mounted on a bracket common to said stapling guns from retracted positions above said locations to operating positions relative to said locations incident stapling the pads to the sleeper, and a pneumatic actuator connected to said bracket for effecting said move.

11. Apparatus for affixing pads spaced along the length of a floor sleeper comprising:

positioning means to hold a sleeper in a working position for affixation of a plurality of pads spaced along the sleeper including an upwardly opening channel wherein the sleeper is held during affixation of the pads, said channel having pairs of parallel bars secured across the opening of said channel at each location for pad affixation, said bars being spaced apart at each location to receive therebetween a pad to be affixed to the sleeper in said working position;

a series of magazines spaced along the length of said positioning means with each magazine adapted to hold a stack of pads:

means associated with each magazine operable to place a pad from the magazine at a predetermined location relative to a sleeper held in said working position by said positioning means; and pad affixing means mounted in operative relation to each said location for affixing the pad to the sleeper at each said location.

12. Apparatus for affixing pads spaced along the length of a floor sleeper comprising:

positioning means to hold a sleeper in a working position for affixation of a plurality of pads spaced along the sleeper including a lifting means for raising the sleeper from a remote position into said working position and an upwardly opening channel having pairs of parallel bars secured across the opening of said channel at each said location for pad affixation, said bars being spaced apart at each location to receive therebetween a pad, a series of magazines spaced along the length of said positioning means with each magazine adapted to hold a stack of pads, each magazine having an upright feeder channel;

means associated with each magazine operable to place a pad from the magazine at a predetermined location relative to a sleeper held in said working position by said positioning means, said pad placing means for each said magazine including an ejector plate mounted to slide toward said parallel bars at the station of the magazine to remove a pad from the stack in each of said magazines and place the pads at said predetermined locations relative to the sleeper; and pad affixing means at all of the locations being mounted to be reciprocal simultaneously from retracted positions above said locations to operating positions relative to said locations incident affixing pads to the sleeper.

* * * * *